US005721530A

United States Patent [19]

Right et al.

[11] Patent Number: 5,721,530

[45] Date of Patent: Feb. 24, 1998

[54] STAND ALONE MODE FOR ALARM-TYPE MODULE

[75] Inventors: Robert W. Right, Huntington, Conn.; Hilario S. Costa, Sarasota; John P. Hewlin, Bradenton, both of Fla.

[73] Assignee: General Signal Corporation, Stamford, Conn.

[21] Appl. No.: 834,686

[22] Filed: Apr. 1, 1997

Related U.S. Application Data

[63] Continuation of Ser. No. 441,803, May 16, 1995, abandoned.

[51] Int. Cl.[6] ..... G08B 19/00

[52] U.S. Cl. ..... 340/521; 340/506; 340/508; 340/505; 340/825.08; 340/531

[58] Field of Search ..... 340/521, 531, 340/506, 508, 505, 825.06, 825.07, 825.08; 364/138, 139

[56] References Cited

U.S. PATENT DOCUMENTS

| | | | |
|---|---|---|---|
| 4,673,920 | 6/1987 | Ferguson et al. | 340/531 |
| 4,812,820 | 3/1989 | Chatwin | 340/531 |
| 4,901,316 | 2/1990 | Igarashi et al. | 371/37.1 |
| 4,951,029 | 8/1990 | Severson | 340/531 |
| 4,954,809 | 9/1990 | Right et al. | 340/516 |
| 4,962,368 | 10/1990 | Dobrzanski et al. | 340/514 |
| 5,017,905 | 5/1991 | Yuchi | 340/506 |
| 5,039,980 | 8/1991 | Aggers et al. | 340/531 |
| 5,117,219 | 5/1992 | Tice et al. | 340/518 |
| 5,267,180 | 11/1993 | Okayama | 364/571.03 |
| 5,298,223 | 3/1994 | Berger et al. | 422/54 |
| 5,347,515 | 9/1994 | Marino | 370/85.2 |
| 5,351,034 | 9/1994 | Berger et al. | 340/577 |

FOREIGN PATENT DOCUMENTS

| | | |
|---|---|---|
| 485878 A2 | 5/1992 | European Pat. Off. . |
| 3128777 A1 | 2/1983 | Germany . |
| 3128788 A1 | 2/1983 | Germany . |
| 3128796 A1 | 2/1983 | Germany . |
| 3128811 A1 | 2/1983 | Germany . |
| 3415819 A1 | 10/1985 | Germany . |
| 4027656 A1 | 3/1992 | Germany . |

*Primary Examiner*—Donnie L. Crosland

*Attorney, Agent, or Firm*—Ohlandt, Greeley, Ruggiero & Perle

[57] ABSTRACT

There is provided an alarm system for detecting and warning of the presence of alarm and trouble conditions in a plurality of zones. The system comprises a loop controller having supply lines extending to the plurality of zones and a module connected to the supply lines within each zones. The module includes means for detecting whether communication between the module and the loop controller has been disrupted. If an alarm condition occurs in a particular zone, the module initiates communication of the alarm condition to the loop controller. During normal operation, when communication with the loop controller has not been disrupted, the module has shared operations with the loop controller to determine whether an alarm condition exists. When communication with said loop controller has been disrupted, temporarily or otherwise, the module continues to operate independently of the loop controller and determines whether an alarm condition exists.

10 Claims, 10 Drawing Sheets

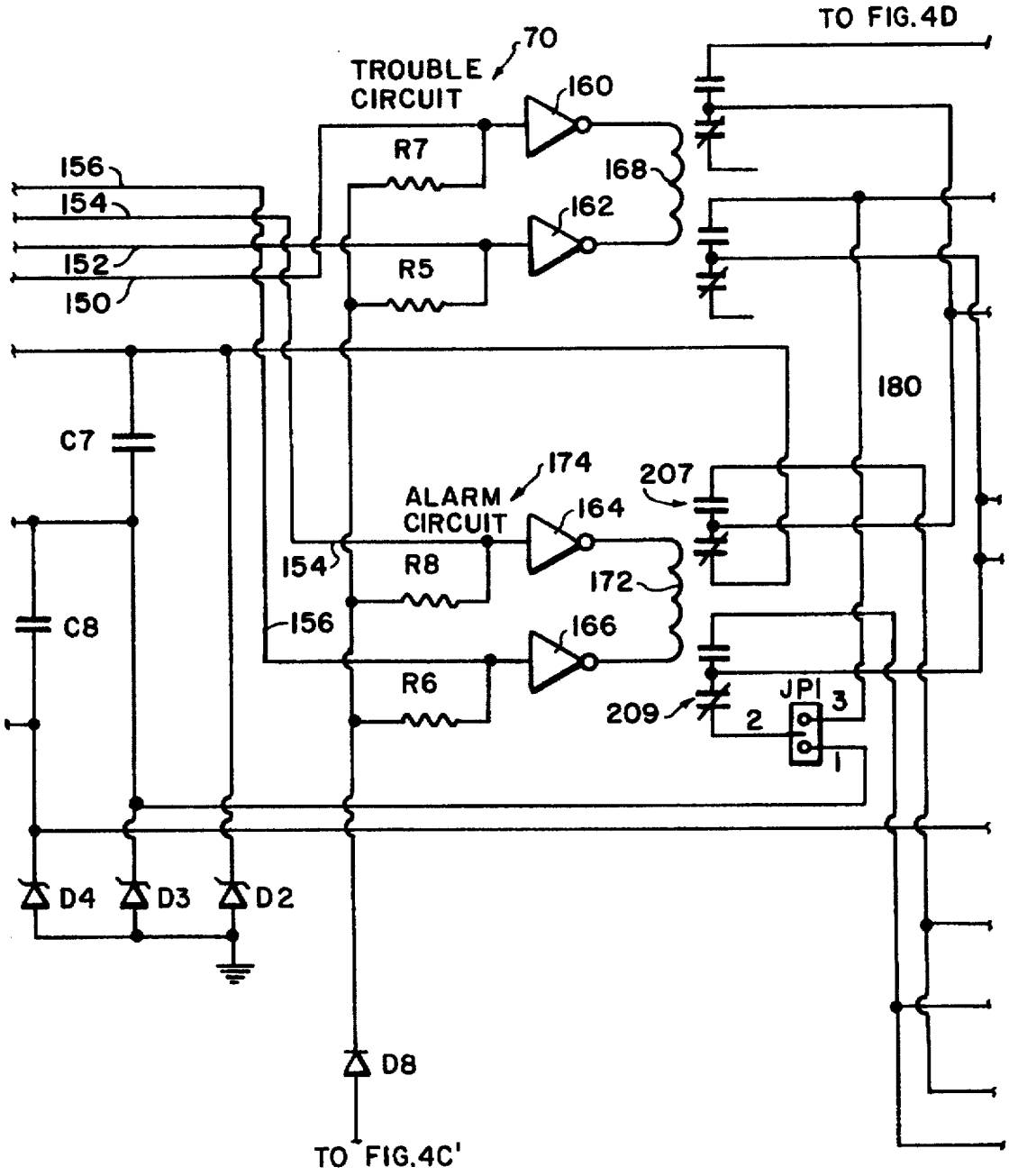
TO FIG.4D
70
TROUBLE CIRCUIT
160
R7
168
162
156
154
152
150
R5
180
C7
174
207
ALARM CIRCUIT
164
154
R8
172
C8
156
166
R6
JP1
3
209
2
1
D4
D3
D2
D8
TO FIG.4C'

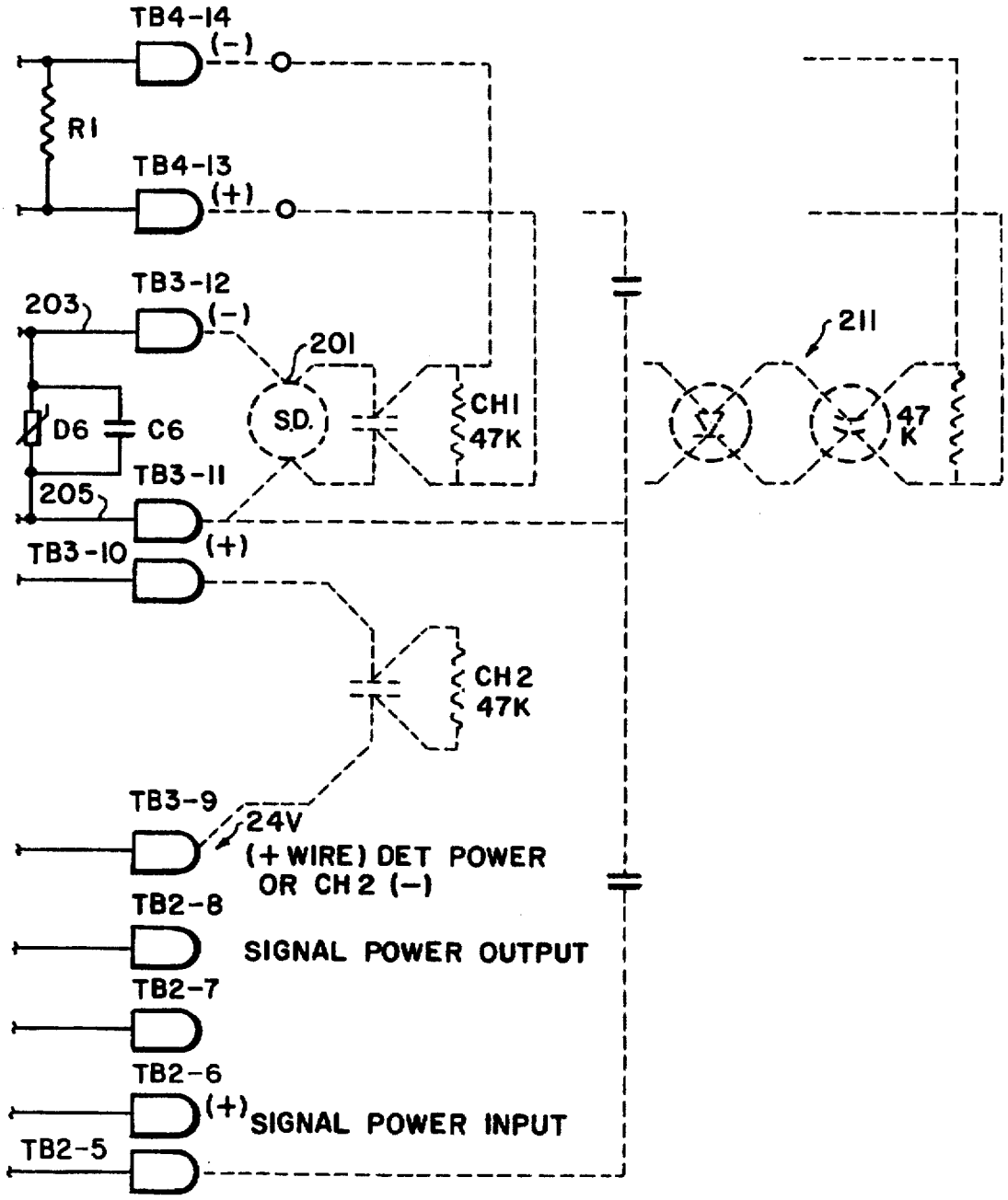
TB4-14
(-)
R1
TB4-13
(+)
TB3-12
(-)
203
201
D6
C6
S.D.
CH1
47K
211
47
K
TB3-11
205
(+)
TB3-10
CH2
47K
TB3-9
24V
(+ WIRE) DET POWER
OR CH2 (-)
TB2-8
SIGNAL POWER OUTPUT
TB2-7
TB2-6
(+)
SIGNAL POWER INPUT
TB2-5

STAND ALONE MODE FOR ALARM-TYPE MODULE

This is a continuation of application Ser. No. 08/441,803, filed May 16, 1995 now abandoned.

The present invention relates to modules, particularly intelligent modules having microprocessor-based control circuitry, that are used within a fire alarm and detection system for the detection and indication of fire-related emergency conditions. Generally, a fire alarm and detection system comprises a fire alarm loop controller that extends control to a loop of devices, such as transponders, modules, detectors and the like, the module of the present invention being one example of such device. More particularly, the present invention relates to an intelligent module, particularly a field programmable module having programmable personalities, of an alarm system having the ability to normally function in conjunction with the loop controller and alternatively function alone when communication with the loop controller has been degraded or disrupted.

The invention of this application is related to inventions described in four other applications with reference to the same fire alarm and detection system: U.S. patent application Ser. No. 08/441,792 filed on May 16, 1995 entitled Field Programmable Module Personalities; U.S. patent application Ser. No. 08/441,811 filed on May 16, 1995 entitled Ground Fault Detection With Location Identification; U.S. patent application Ser. No. 08/441,754 filed on May 16, 1995 entitled Line Monitor For 2-Wire Data Transmission; and U.S. patent application Ser. No. 08/441,762 filed on May 16, 1995 entitled Loadshed Method of Power Conservation.

BACKGROUND OF THE INVENTION

The present invention is in the field of fire alarm and detection systems. Examples of prior systems of this general type may be appreciated by reference to following U.S. patents: U.S. Pat. No. 4,568,919 to J. Muggli, et al., which issued on Feb. 4, 1986; U.S. Pat. No. 4,752,698 to A. Furuyama, et al., which issued on Jun. 21, 1988; U.S. Pat. No. 4,850,018 to W. R. Vogt, which issued on Jul. 18, 1989; U.S. Pat. No. 4,954,809 to R. W. Right, et al., which issued on Sep. 4, 1990; U.S. Pat. No. 4,962,368 to J. J. Dobrzanski, et al, which issued on Oct. 9, 1990.

Most of the above cited U.S. patents describe systems that are approximately six to ten years old, and in most of these systems the loop controller initiates the determination of the states of the units at the various zones or stations in the system by the use of a repetitive polling scheme for polling the detector units or stations from the loop controller, whereby addresses are sent successively on the loop or lines to determine which, if any, units are in an alarm state. Provision is also made in most of these systems to detect trouble conditions in the system.

Other fire detector and alarm systems have been developed in the recent past, that is, in the past five years or so, that provide a variety of features, including the feature of an intelligent transponder combined with an integral processor, such that communication to the loop controller of the fact that a particular transponder is in alarm is initiated by the transponder. This is sometimes called polling by exception. This results in lower communications speed while substantially improving control panel response time. Such a feature makes the system less sensitive to line noise and to loop wiring properties; hence, twisted or shielded wire is not required.

The above described intelligent transponder feature may be appreciated by reference to several U.S. patents. Many of these prior art patents describe central receivers having improved intelligence for communication with a plurality of satellite devices. For example, U.S. Pat. No. 4,901,316 to A. Igarashi, et al. entitled DISASTER PREVENTION MONITORING AND CONTROL FACILITY provides a central receiver for polling a plurality of terminal units. The receiver reads terminal information from the terminals, analyzes the terminal information, and displays the results of its analysis. Also, the receiver monitors the accuracy of transmissions between the receiver and the terminal units. Thus, the receiver can accurately check for an erroneous transmission of a signal that may occur between the receiver and one of the terminal units.

The feature of improving the intelligence of satellite devices that are connected to a central receiver is also known. For fire alarm systems, one or more unaddressable slave devices may be connected to a single addressable master device that is, in turn, connected to a central receiver. The master device makes decisions, such as whether a particular surveillance area is in alarm, on behalf of the slave devices. For example, U.S. Pat. No. 5,017,905 to S. Yuchi entitled FIRE ALARM SYSTEM provides a system including a plurality of addressable detectors connected to a central receiving unit or receiver in which each addressable detector monitors a group of unaddressable slave detectors that are located within the particular surveillance area. Similarly, U.S. Pat. No. 5,117,219 to L. D. Tice, et al. entitled SMOKE AND FIRE DETECTION SYSTEM COMMUNICATION provides a system having a central controller that transmits data to remote master devices including smoke/fire detectors and modules. Each module is connected to a peripheral slave device, such as a sounder, strobe, door closer or water flow switch.

It is further known that fire detectors may also perform calculations to determine the likelihood of a fire-related condition. For example, U.S. Pat. No. 5,267,180 to Y. Okayama entitled FIRE ALARM SYSTEM HAVING PRESTORED FIRE LIKELIHOOD RATIO FUNCTIONS FOR RESPECTIVE FIRE RELATED PHENOMENA provides a system having a central receiver for collecting environmental data, such as temperature level, smoke density or gas concentration, of a particular surveillance area from a fire detector. Also, the central receiver applies the data to a respective fire likelihood ratio function and processes the result to improve the accuracy of decision making with respect to fire-related conditions.

However, such transponders of the prior art do not provide for their independent operation when communication with the central receiver or controller has been substantially degraded or disrupted. Also, such transponders do not operate as master devices that control or monitor the operation of peripheral slave devices and indicate an alarm condition to the loop controller, in one form or another, when such degradation or disruption of communication has occurred.

Against the foregoing background, it is a primary object of the present invention to provide an alarm system for detecting and warning of the presence of alarm and trouble conditions in a plurality of zones that includes in each zone, as one example, a module having the capability of operating alone or in conjunction with the loop controller.

It is another object of the present invention to provide a module for an alarm system that has a normal mode of operation in conjunction with the loop controller to determine an alarm condition and also has a stand alone or backup mode for independent operation when polling from the loop controller has been degraded or disrupted.

It is a further object of the present invention to provide such a module for the alarm system such that, in stand alone mode, the module is capable of transmitting an alternative communication signal that includes an alarm indication to the loop controller.

It is still further object of the present invention to provide a module for an alarm system having field programmable module personalities in which the module reverts to stand alone operation for certain specific personalities, such as alarm-type personalities, when the loop controller fails and communication with the module is degraded or disrupted.

SUMMARY OF THE INVENTION

Before getting into the summary of the invention, it is well to consider the following definitions:

A module when referred to hereinafter is an electronic circuit that is interconnected over the same wire pair as smoke detectors. Thus, in the system which forms the context of the present invention, modules have been incorporated in each of the units located at various zones or stations of the system, and these modules are connected over the same wire pair as the smoke detectors or other sensing devices at the given station. Smoke detectors monitor particles of combustion while the modules themselves monitor external contact closure activity in connection with the outbreak of fire or the like, and these are such as the following: heat detectors, fire alarm pull stations, door closures, fan shutdown, audible and visual signal devices, etc.

To accomplish the foregoing objects and advantages, the present invention, in brief summary, is an alarm system for detecting and warning of the presence of various alarm conditions by means of transponders located in a plurality of zones, the system having a backup mode of alarm operation during hardware or software failures, the system comprising: a loop controller having a plurality of supply lines extending to the transponders; a module, within each of the transponders and connected to the plurality of supply lines, being capable of initiating communication of the conditions in its respective zone to the loop controller and having shared operations with the loop controller for the determination of an alarm condition in its respective zone, the module including means for detecting whether normal communication from the loop controller to the module has been disrupted; a plurality of devices having respective circuits coupled to the module; and means, within the module, responsive to a disruption of the normal communication from the loop controller to the module, for providing alternative communication to the loop controller including means for generating an alarm signal to indicate an alarm condition within the respective zone of the module.

Other and further objects, advantages and features of the present invention will be understood by reference to the following specification in conjunction with the annexed drawings, wherein like parts have been given like numbers.

BRIEF DESCRIPTION OF THE DRAWINGS

FIGS. 4A–4D and 4A'–4C' together form a schematic diagram of the module of FIG. 1.

DETAILED DESCRIPTION OF THE PREFERRED EMBODIMENT

Figure 1:
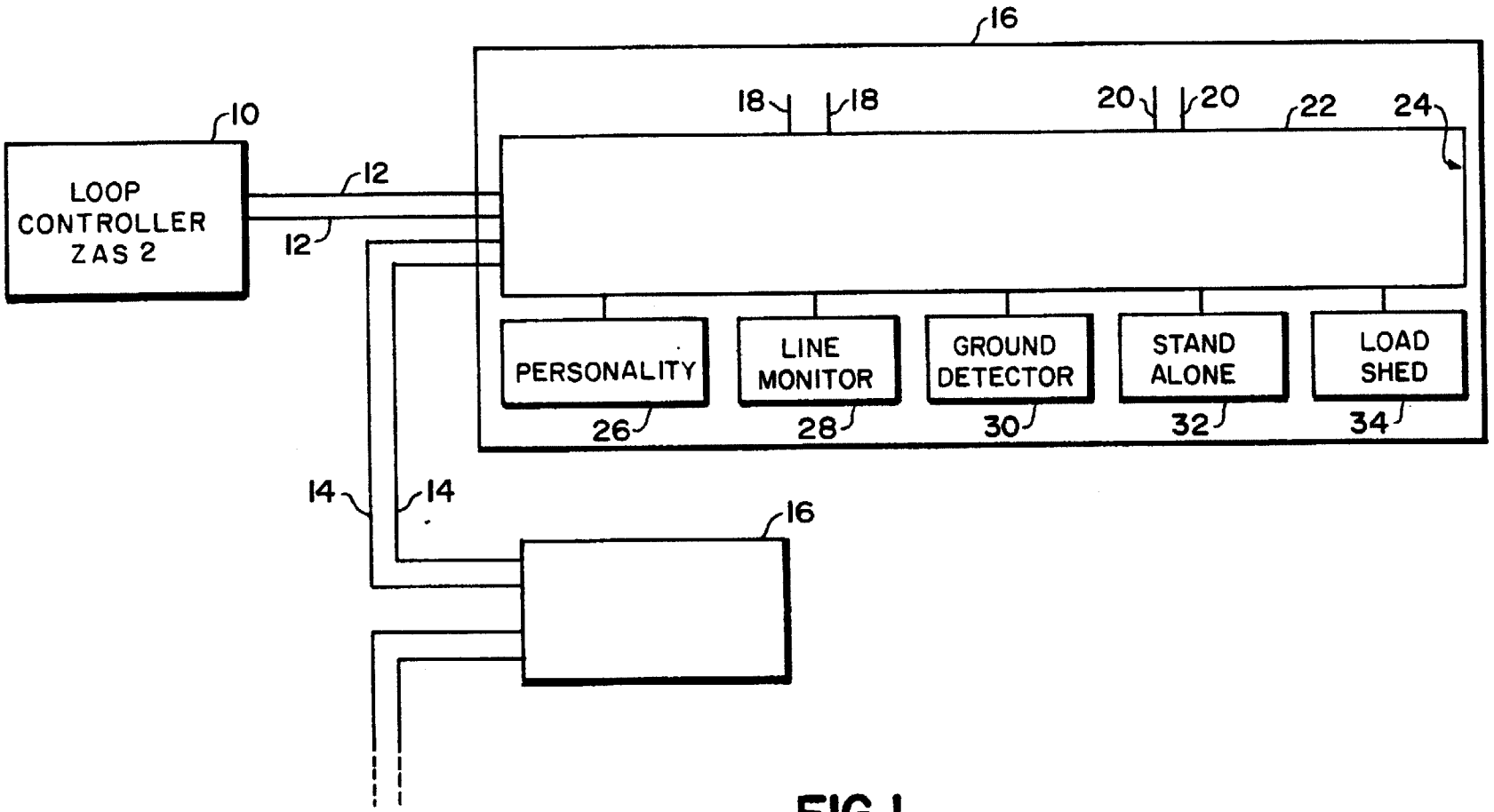
FIG. 1 is a block diagram which provides an simplified overview of the alarm system, having particular modules embodied, in which the present invention is incorporated, including transponder units.

Referring to the drawings and, in particular, to FIG. 1, there is provided a simplified showing of the system context in which the present invention operates in order to provide, as one example, a module having the capability of continued operation and indicating an alarm condition when communication with the loop controller is not functioning properly, as described below.

System and Common Module Circuitry

Referring to FIG. 1, there is provided a loop controller of the preferred embodiment which is generally represented by reference numeral 10. The loop controller 10 is connected by multiple-wire outgoing and return cable 12 to a first transponder unit 16 which, in turn, is connected by a multiple-wire cable 14 to the next transponder unit 16 and so on to other units. Within the first transponder unit 16, there are seen a block designated 22 representing common components of a module 24 whose inputs/outputs are represented by pairs of lines 18 and 20, which may be supplied with 24 volts D.C. and can be variously connected by selective control of the module to provide different modes of operation for the transponder unit 16.

Also seen connected to the lower part of the module 24 are the several inventive features integrally embedded in the module circuitry, namely a personality feature 26, line monitor feature 28, ground detector feature 30, stand alone feature 32 and load shed feature 32. The stand alone feature 32 is the feature herein described and claimed, which involves independent and continued operation of the transponder when communication from the loop controller 10 has been disrupted. The personality feature 26 is described and claimed in co-pending U.S. patent application Ser. No. 08/441,792, and the line monitor feature 28 is described and claimed in co-pending U.S. patent application Ser. No. 08/441,754 which is incorporated herein by reference. Similarly, the ground detector feature 30 is described and claimed in co-pending U.S. patent application Ser. No. 08/441,811, and the load shedding feature 34 is described and claimed in co-pending U.S. patent application Ser. No 08/441,762. The details of the disclosures of all of the preceding are incorporated herein by reference to the related patent applications already noted.

Figure 2:
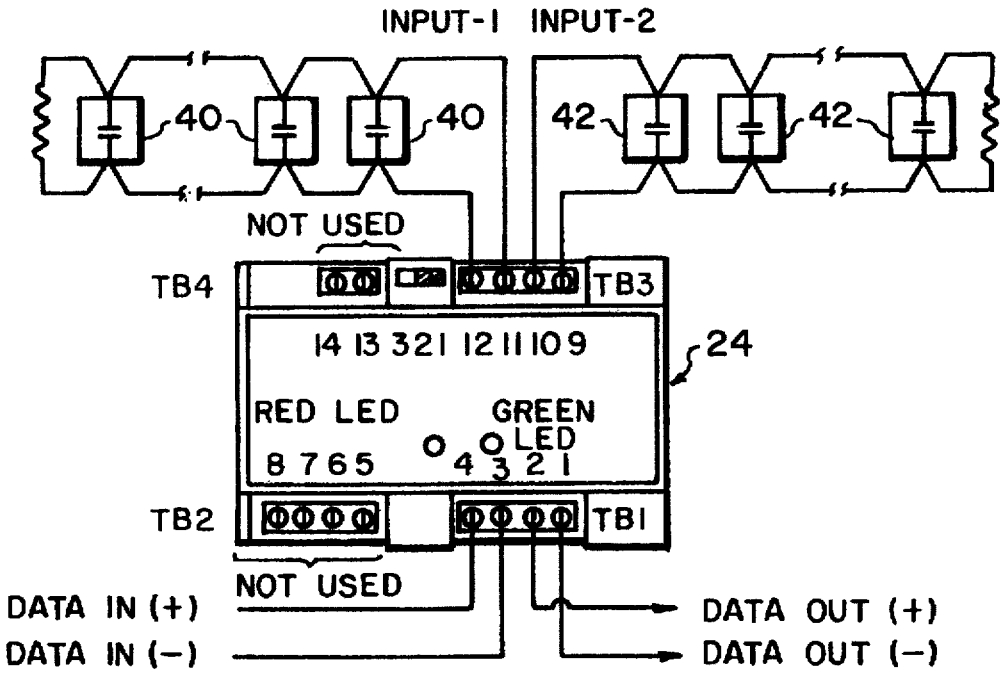
FIG. 2 is a block-schematic diagram of a class B dual input arrangement for a module with particular input circuits depicted therefor and incorporating the present invention.

Referring to FIG. 2, there is depicted the module 24 that can be arranged, in one example, to operate class B as a dual input module. Moreover, in this figure, connections of "data in" lines and "data out" lines are seen made to terminal blocks at the bottom of the modules, these lines corresponding, respectively, to lines 12 and 14 in FIG. 1. However, what is not seen in FIG. 1, are the particular class B input connections which are effectuated by the switch contacts 40 in input circuit 1 and the contacts 42 in input circuit 2.

Figure 3:
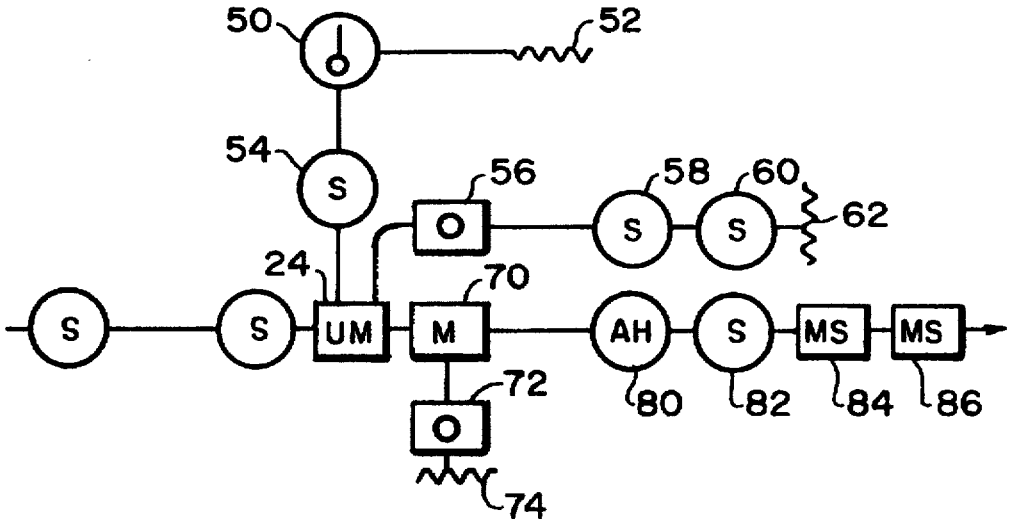
FIG. 3 is a block diagram of part of a general alarm system that includes the module of FIG. 1, and particularly illustrates a variety of devices in the form of smoke detectors and other units connected at a given zone or station corresponding to the module.

FIG. 3 illustrates the system, where focus is on the selected circuitry or circuit pathways extending from the module 24 which, as previously discussed, is part of a transponder unit 16 located at a given zone or station. The module 24 is depicted in association with a variety of devices in, for example, input circuits. Such devices can be selected as a package with such module 24, or the module can be incorporated into an already existing system, that is, retrofitted to an older style system to bring it up-to-date. Thus, as shown in FIG. 3, two loops extend from the upper portion of the module. One loop includes a heat detector 50, an end of line resistor 52 and a conventional smoke detector 54. In the other loop, there is a manual station 56, and two conventional smoke detectors 58, 60 with an end of line resistor 62 for that other loop. Also connected to the module 24 is a plurality of intelligent devices, including a monitor module 70 and its associated "dumb" devices, namely a manual station 72 and an end of loop resistor 74. Also, an intelligent analog heat detector 80, an intelligent analog smoke detector 82, analog manual stations 84 and 86 extending further down the loop from the module 24 beyond the aforenoted monitor module 70.

The Stand Alone Feature

The stand alone features is a fail-safe or fail back provision that becomes active when the controlling circuitry of the loop controller 10 fails or is otherwise unable to communicate with the module 24. FIGS. 4A through 4D and 4A' through 4C' are combined to form a schematic diagram of a transponder in which a module 24 having the stand alone feature is embodied. Normally, the data lines that extend from the loop controller 10 to the module 24 accomplish data communication as well as synchronous power transmission. For the preferred embodiment, communication signals in the form of three command voltages, i.e., zero volts, 9 volts and 19 volts, are transmitted from the loop controller 10 to the module 24. These voltages are sent by way of connection 90 from terminal TB1-4 in FIG. 4C' (through FIGS. 4B' and 4A') to a discriminator circuit 92 in FIG. 4A. In turn, the discriminator circuit 92 produces a binary output for these three terminals, particularly for terminals "13" and "43" as shown in FIG. 5, that is based on the three levels of voltages coming in through connection 90.

If the loop controller 10 fails and no longer communicates with the module 24, the module would time out and begin operating in a stand alone mode. In such a situation, the module 24 can determine whether the loop controller 10 has failed by monitoring the connecting data lines 12 for signal activity. The loop controller 10, upon failure, supplies a steady state 19 volt supply of power, instead of its normal combination of data communication and power transmission, along the data lines 12 in order to maintain power to the detectors and modules along those data lines. If loop controller's communications with the module 24 fail for more than a predetermined time period, i.e., no valid communications interrupt received along with the steady state 19 volt power, the module 24 goes into stand alone mode. It is preferred that this predetermined time period is about 4 to 8 seconds.

The module 24 continuously monitors the input data lines 12 for activity from the loop controller 10. The communication between the loop controller 10 and the module 24 utilizes a "voltage out/current back" method. If only the steady state 19 volt level is detected, then the module 24 knows that it can't send a normal alarm condition signal, i.e., voltage-out data to the loop controller 10 and reverts to the stand alone mode of operation. Each module 24 along the loop continues to collect and analyze information from its slave devices, which include heat detector 50, manual station 56, and conventional smoke detectors 54, 58 and 60 (shown in FIG. 3). In addition, the modules are still capable of indicating an alarm condition to the loop controller when such a condition exists. For such alarm conditions, in order to send an alarm signal to the loop controller 10, the module 24 will transmit a steady state current on the data lines to the loop controller. The steady state current transmitted by the module 24 is twice as high as the normally transmitted data pulses or current pulses. For example, if the current pulses normally transmitted are 10 mA, then the steady state current for the alarm signal is about 20 mA. Backup circuitry in the loop controller 10 will detect this incremental increase in current that is the result of the module 24 being in stand alone alarm mode and generate a general alarm for alerting the local public and operating personnel.

The microcontroller 96 is the centerpiece or control center of the module 24 that substantially performs the intelligent operations of the module, such as the execution of the stand alone feature. For the preferred embodiment, this microcontroller 96 is selected to have an NEC microprocessor, model no. 75028. The input and output ports of the microcontroller 96 are connected to a variety of circuits within the module. For all references to the schematic of FIGS. 4A through 4D and 4A' through 4C', particularly references to terminal or pin connections, reference should also be made to the magnified view of microcontroller 96 shown in FIG. 5.

For the preferred embodiment, the stand alone feature of the present invention has been implemented in the memory portion of the microcontroller 96. The memory portion of the microcontroller 96 includes circuits that are external to the microcontroller, such as EEPROM 126 shown in FIG. 4A. The module 24 makes decisions independent of the loop controller 10 and is capable of sending an alarm signal to the loop controller even if the loop controller's polling interrogation is degraded or disrupted. Within the microcontroller 96, a counter, which is initialized to zero and reset to zero with every valid communications, is incremented every cycle, preferably every 0.5 second. When the counter rolls over, the stand alone mode of operation is initiated. Thus, a decentralized alarm decision by the module 24 is guaranteed since on-board intelligence, i.e., microcontroller 96, permits the module to operate in stand alone mode.

The microcontroller 96 enhances the module's "survivability" since it allows the module 24 to function in the stand alone mode, as opposed to waiting for communication from the loop controller 10. In the event that the polling from the loop controller 10 is interrupted, the module 24 is able to continue operating and detect fire-related conditions indicated by the slave devices connected thereto. Also, the module 24 is still able to indicate an alarm condition and send an alarm signal to the loop controller 10 during stand alone mode, as described above.

In addition, a watch dog circuit 124 in the microcontroller 96 monitors polling communication and automatically switches the loop wiring to circuitry similar to a traditional, hardwired zone. If any device connected to the module 24 goes into the alarm state, the loop controller 10 will accept the alarm signal from the module.

An impedance is placed across the data lines 12 during an alarm condition to produce the steady state current for the alarm signal and indicate to the loop controller 10 that an alarm condition has occurred. In particular, the impedance across the data lines 12 are primarily controlled by the green LED circuitry 114 and red LED circuitry 116 shown in FIGS. 4A' and 4B', respectively, which are in the current path of the data lines 12. Normal communications are produced through the green LED circuitry 114 for normal or trouble mode or the red LED circuitry 116 for the active or alarm mode. Microcontroller 96 produces voltage pulses (3.3 volts) that drive a transistor Q5 of the green LED circuitry and a transistor Q6 of the red LED circuitry. The transistors Q5, Q6 are in a configuration that is similar to an emitter follower which provides constant current. During reserved time periods, the module 24 has the ability to communicate back to the loop controller 10 by sinking current and producing 10 mA current pulses through the data lines 12.

In stand alone mode, the microcontroller 96 drives both the green LED circuitry 114 and the red LED circuitry 116. Specifically referring to FIGS. 4A, 4A', 4B' and 5, terminal "55" of the microcontroller 96 sends a signal through connecting means 97 to the base of transistor Q5 and, likewise, terminal "54" of the microcontroller sends a signal through connecting means 99 to the base of transistor Q6. Since both the transistors Q5, Q6 of the green and red LED circuits 114 and 115 are activated, 20 mA of current is produced on the data lines 12. Thus, the loop controller 10 knows that one of the transponders along the loop is sending an alarm signal.

For example, an alarm signal is to be sent to the loop controller 10 by way of an output port, i.e., terminal "55" on the microcontroller 96, to the input of a transistor Q5 by a connection means 97. This results in conduction of the transistor Q5 and turn on of the red LED in circuit 116 to produce 10 mA of current along the data lines 12. Similarly, a trouble signal is sent to the loop controller 10 by way of terminal "54" on the microcontroller 96 to the input of a transistor Q6 by a connection means 99 and, thus, results in conduction of the transistor Q6 and turn on of the green LED in circuit 114 and produce another 10 mA of current along the data lines 12. Thus, the consequence of sending both the alarm signal or the trouble signal is a voltage change on the data lines 12 and a total current of about 20 mA on the data lines 12. Thus, the current draw by the module 24 is detected by the loop controller 10 as a means to enunciate alarm conditions when communications has failed. In addition, both LED's of the green and red LED circuits 114, 116 light up to indicate an alarm condition to anyone in viewing range of the module 24.

Figure 4A:
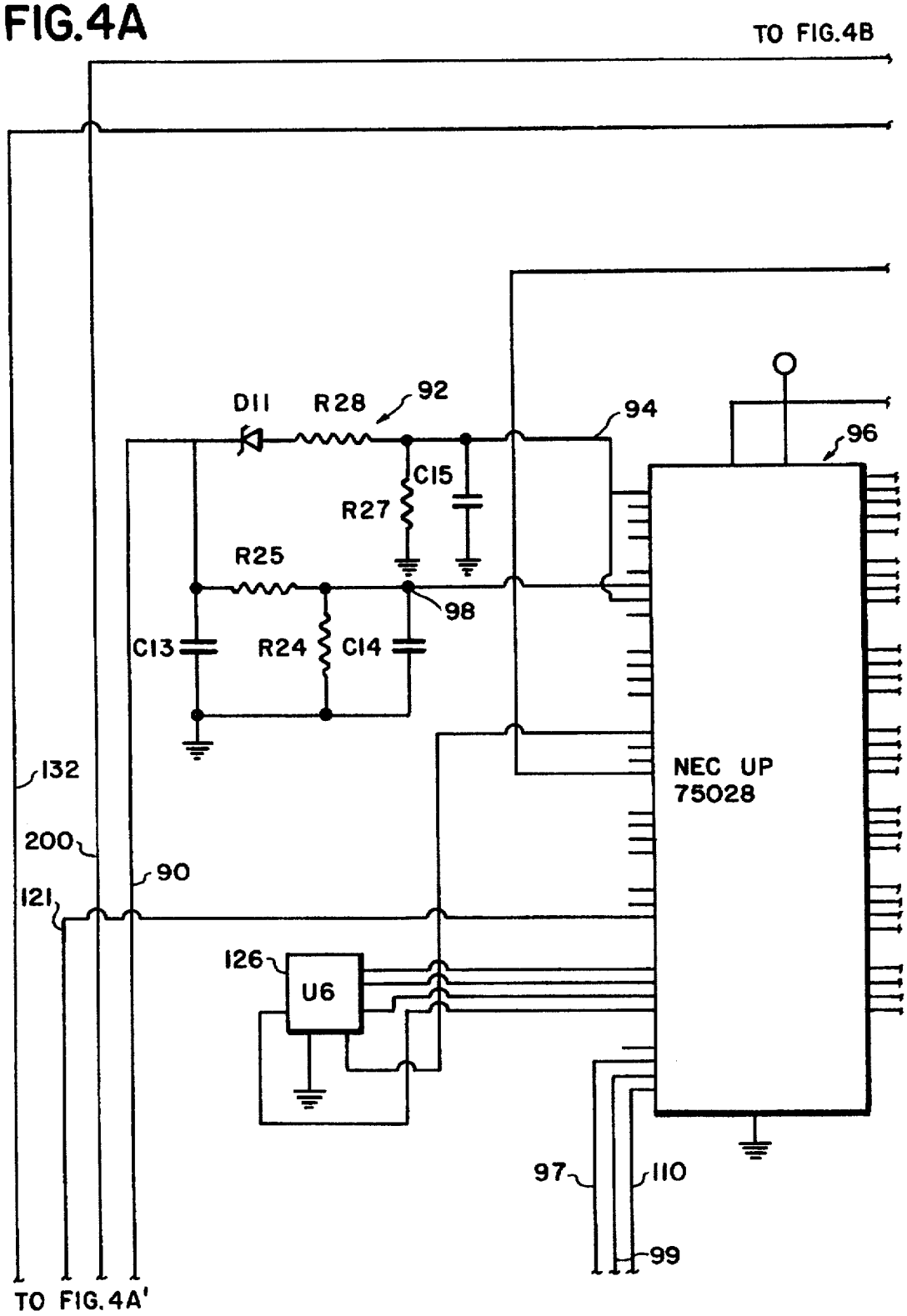
Figure 4B:
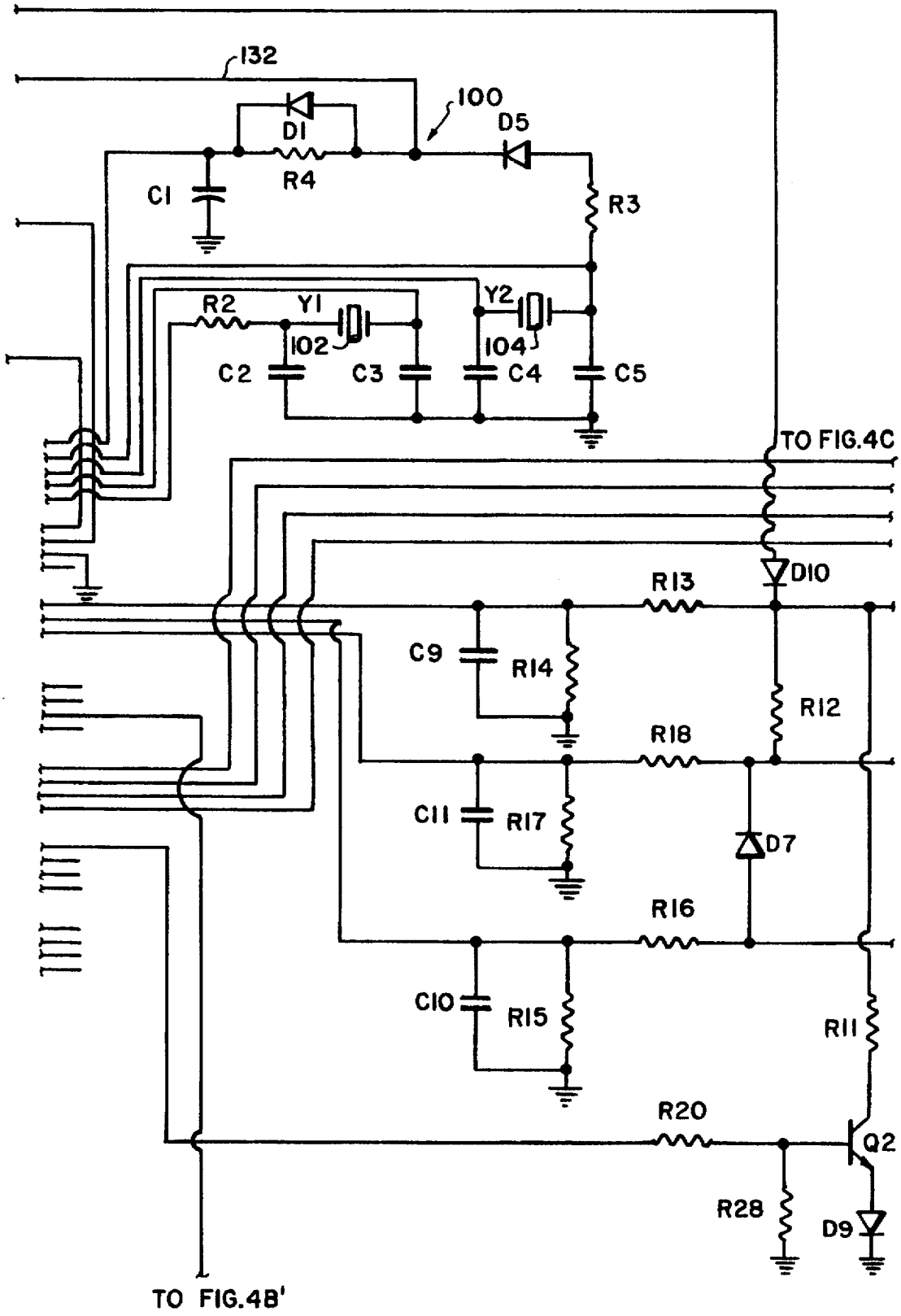
Figure 4A:
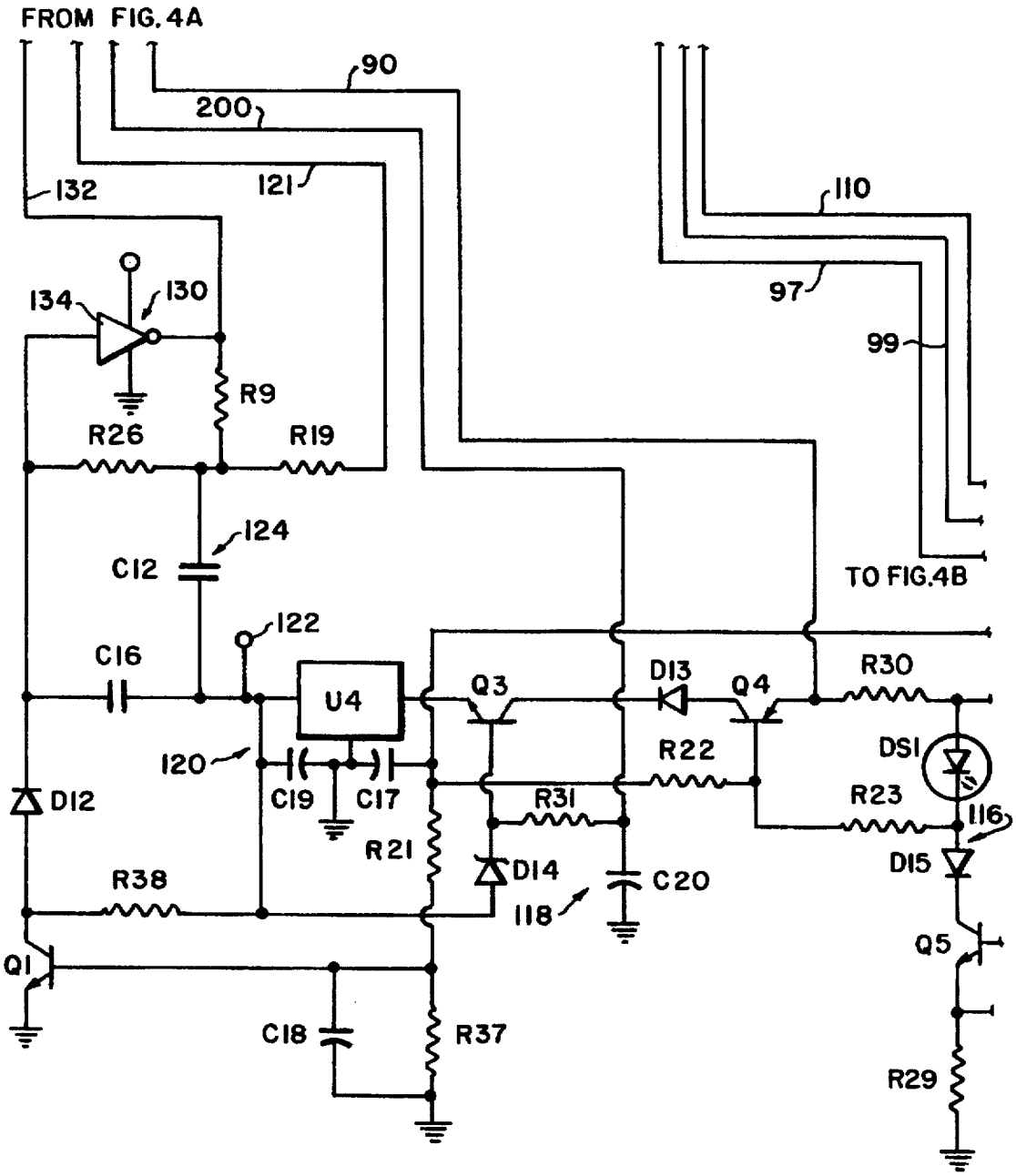
Figure 4B:
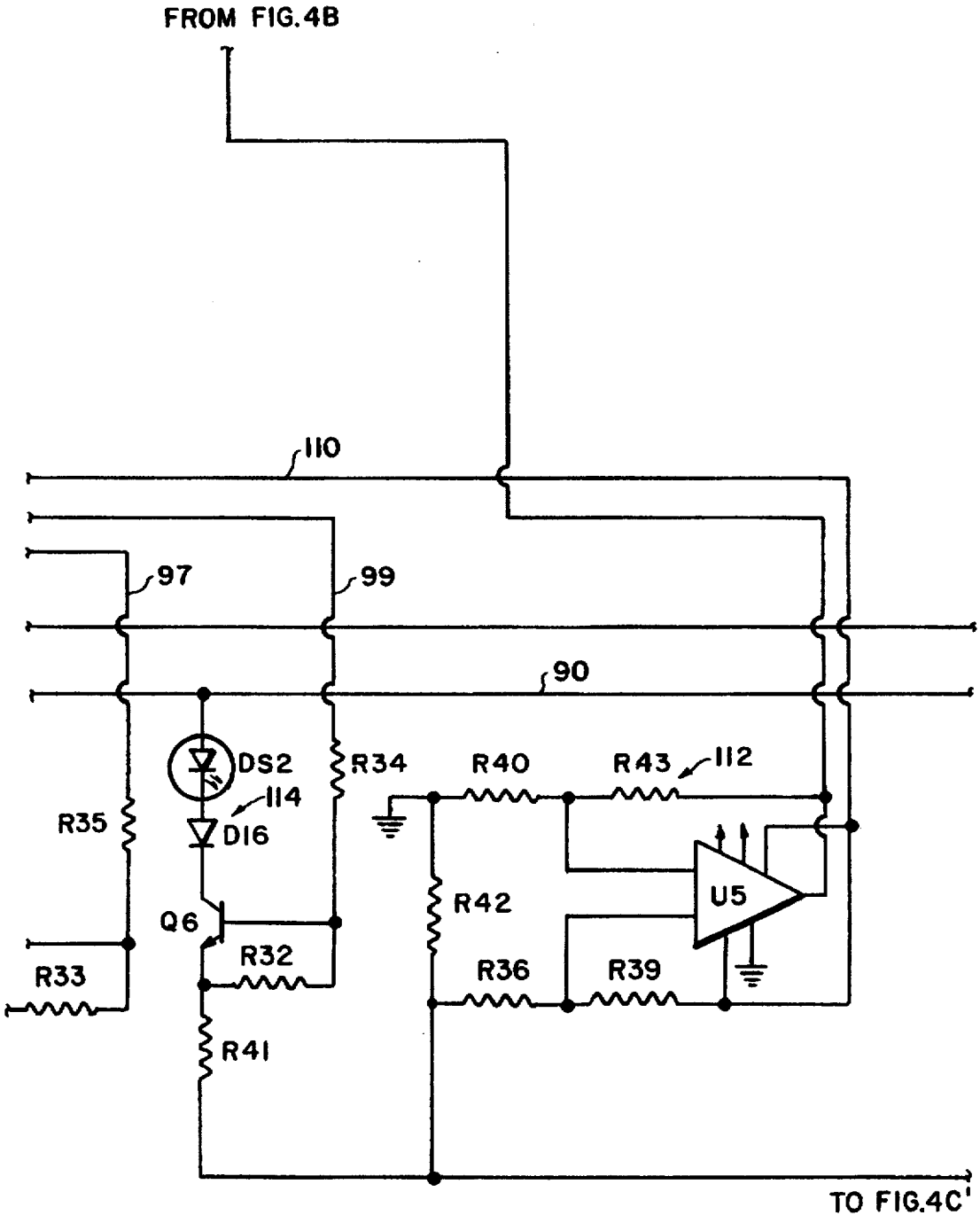
Figure 4C:
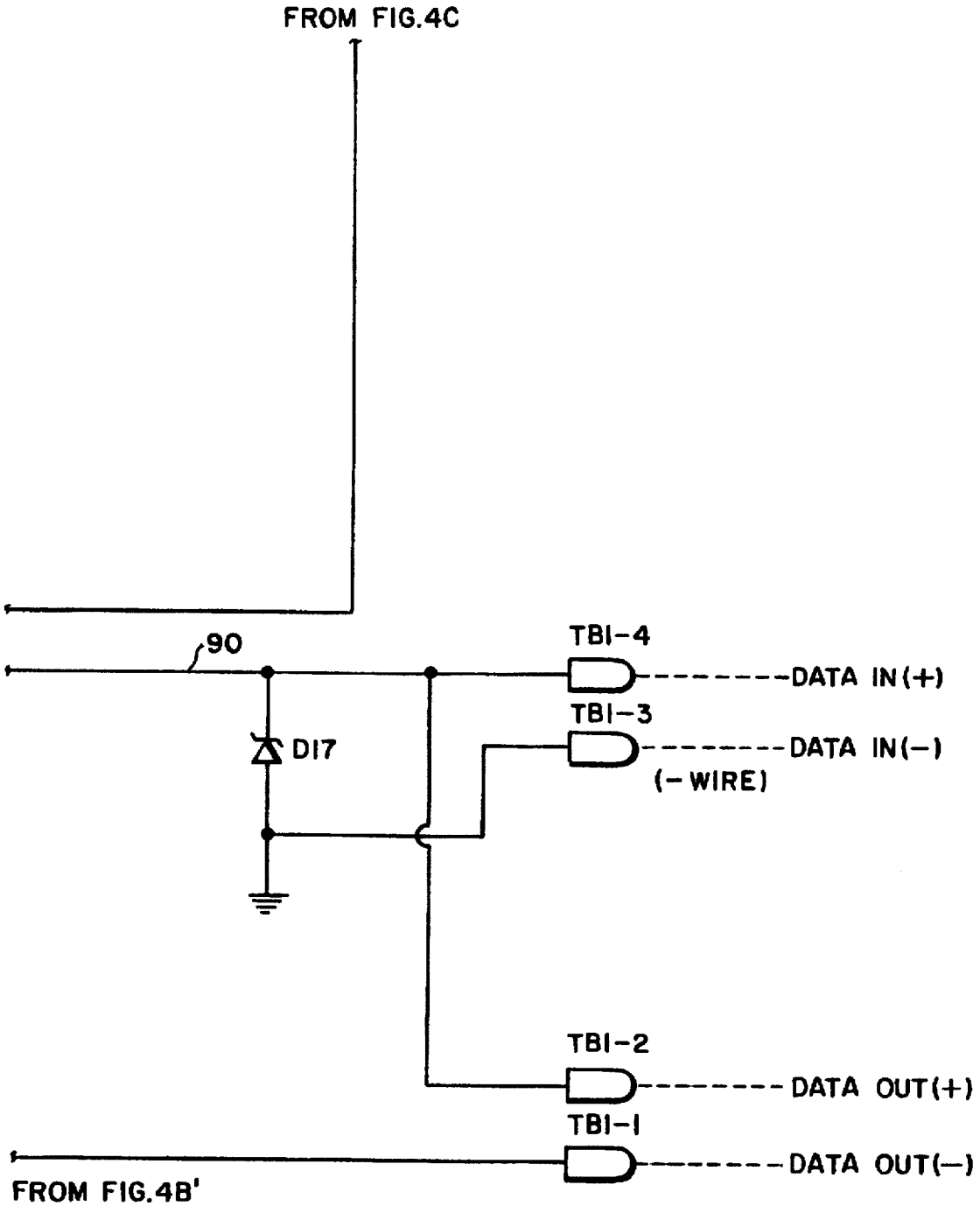
Figure 5:
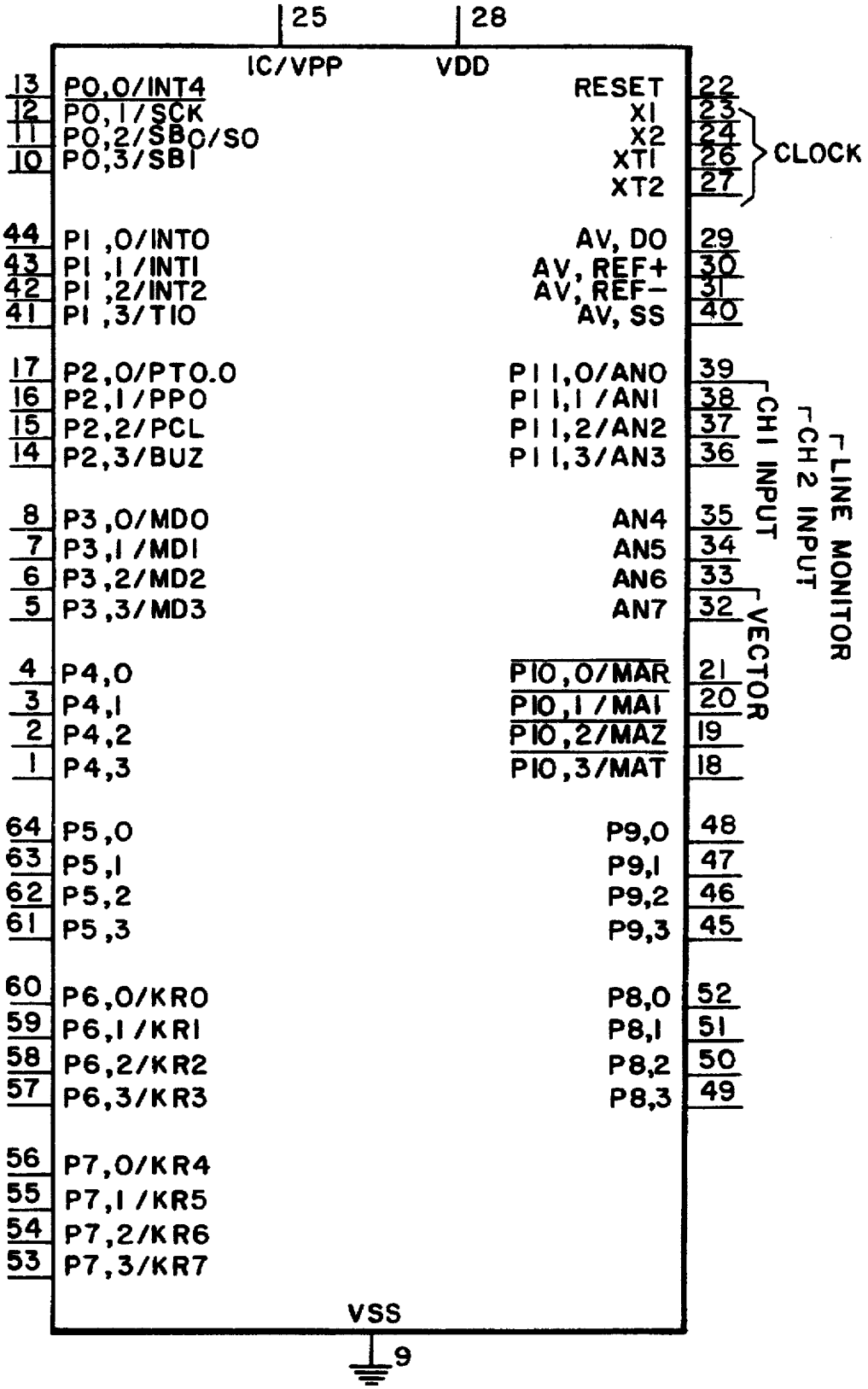
FIG. 5 is a magnified view of the microcontroller of the module of FIG. 4A.

To monitor the operation of the various connected slave devices, the module 24 communicates to such devices through terminal contacts 5 through 14 (TB2-5 through TB2-8, TB3-9 through TB3-12, and TB4-13 and TB4-14) as shown in FIGS. 4C' and 4D. Referring to FIGS. 4A through 4D and FIG. 5, terminals "18" through "21" of the microcontroller 96 controls the relay contacts of the trouble circuit 170 and the alarm circuit 174 provide appropriate output signals to devices connected to terminal contacts 5 through 14. Likewise, terminals "37" through "39" of the microcontroller 96 receive input signals from the devices connected to terminal contacts 5 through 14. Thus, microcontroller 96 is capable of transmitting and receiving a wide variety of signals to and from devices that are connected to terminal contacts 5 through 14. These transmissions and receptions by the microcontroller 96 shall continue to occur regardless of whether communication from the loop controller has been degraded or disrupted.

The loop controller 10 includes a detection mechanism for identifying the incremental changes in current along the data lines 12. This detection mechanism becomes active whenever the loop controller recognizes that its communication with the devices along the loop, including the module 24, is hindered. The loop controller 10 has a variable load that varies with the type and quantity of modules that are changed within the system configuration of the alarm system. The loop controller 10 sets a hardware comparator threshold that is based on the normal average line current for its particular system configuration. For the preferred embodiment, the threshold is set at 18 mA. When the actual line current of the data lines is exceeded by 18 mA, the loop controller 10 knows that the module has generated an alarm signal. As described above, the green and red LED circuits 114, 116 of the module 24 will produce about 20 mA of current on the data lines 12, which is sufficient to notify the loop controller 10. As a result, the loop controller 10 with indicate a general alarm by, for example, sounding an alarm or alerting the operator of the alarm condition.

As stated above, the present invention is particularly useful for modules having field programmable module personalities, as described in co-pending U.S. patent application Ser. No. 08/441,792. For modules that may be programmed to have one of many different personalities, it is preferred that the present invention be active for those particular personalities that are alarm-type personalities. The module 24 would know what personality has been assigned to it by looking at its configuration bits, for example, in certain registers of the EEPROM 126. If the module 24 identifies itself as having an alarm type personality, the modules will generate a stand alone or alarm signal if the module is in stand alone mode and an alarm condition exists. For non-alarm type personalities, the stand alone or alarm signal would not be generated since the loop controller 10 does not necessarily need to be aware of non-alarm occurrences, such as trouble in one of the modules or the closing of a door. Accordingly, the present invention accommodates modules having programmable personalities, as described above.

The invention having been thus described with particular reference to the preferred forms thereof, it will be obvious that various changes and modifications may be made therein without departing from the spirit and scope of the invention as defined in the appended claims.

Wherefore, we claim:

1. An alarm system for detecting and warning of the presence of various alarm conditions by means of transponders located in a plurality of zones, said system having a backup mode of alarm operation during hardware or software failures, said system comprising:

a loop controller having a pair of supply lines extending to said transponders;

a module, within each of said transponders and connected to said pair of supply lines, for initiating communication of the conditions in its respective zone to said loop controller and having shared operations with said loop controller for determining an alarm condition in its respective zone, said module including means for detecting whether said loop controller is not capable of having normal communication with said module, across said pair of supply lines;

a plurality of devices having respective circuits coupled to said module; and means, within said module, responsive to a disruption of said normal communication from said loop controller to said module, for providing alternative communication to said loop controller across said pair of supply lines including means for generating an alarm signal to indicate an alarm condition within the respective zone of said module.

2. The alarm system of claim 1, wherein said normal communication includes various information regarding the status of said module whereas said alternative communication includes a lesser amount of information.

3. The alarm system of claim 2, wherein said alternative communication is simply an alarm signal that indicates whether an alarm condition exists.

4. The alarm system of claim 1, wherein said means for detecting of said module determines that said communication from said loop controller has been disrupted if a particular time period has passed since detecting a previous valid communication.

5. The alarm system of claim 4, wherein said particular time period is about 4 seconds to about 8 seconds.

6. The alarm system of claim 1, wherein said modules collects and analyzes information from plurality of devices to determine whether said alarm condition exists in its respective zone.

7. The alarm system of claim 1, wherein said module includes mean for substantially providing the functions that are generally provided by said loop controller when said communication from said loop controller to said module has not been disrupted.

8. The alarm system of claim 1, further comprising means for transmitting an alarm signal to said loop controller when said means for determining determines that said alarm condition exists and when said means for detecting detects that said communication of said loop controller to said module has been disrupted.

9. The alarm system of claim 1, further comprising means, responsive to the storage of specific configuration data, for selecting respective modes of operation for said circuits.

10. The alarm system of claim 1, wherein said module, when initiating said normal communication, transmits voltage level signals, across said pair of supply lines, and wherein said module, upon initiating said alternative communication, transmits current level signals, across said pair of supply lines.

* * * * *